US005813786A

United States Patent [19]

Fraenkel

[11] Patent Number: 5,813,786

[45] Date of Patent: Sep. 29, 1998

[54] WRITING INSTRUMENT

[76] Inventor: Amir Fraenkel, Uziel St. 28/9, Jerusalem 96424, Israel

[21] Appl. No.: 613,769

[22] Filed: Feb. 28, 1996

[30] Foreign Application Priority Data

Mar. 1, 1995 [IL] Israel ..... 112838

[51] Int. Cl.[6] ..... B43K 29/00; B43K 23/02

[52] U.S. Cl. ..... 401/195; 40/131; 24/10 R; 24/11 F; 24/562

[58] Field of Search ..... 401/195, 52, 131; 24/10 R, 11 F, 11 CT, 555, 562, 561, 556, DIG. 22, 67.9

[56] References Cited

U.S. PATENT DOCUMENTS

| | | | |
|---|---|---|---|
| 884,256 | 4/1908 | Addie . | |
| 1,102,992 | 7/1914 | Hoffman . | |
| 1,282,511 | 10/1918 | Williams et al. | 401/195 X |
| 1,509,876 | 9/1924 | Ricerra | 401/52 X |
| 1,586,656 | 6/1926 | Corey | 24/561 X |
| 2,171,188 | 8/1939 | Morris | 401/52 |
| 2,288,878 | 7/1942 | Baer . | |
| 2,298,247 | 10/1942 | Sampson . | |
| 2,332,772 | 10/1943 | Amer | 24/561 X |
| 2,802,250 | 8/1957 | Klotz . | |
| 3,283,421 | 11/1966 | Schott | 24/67.9 X |
| 3,808,651 | 5/1974 | Almendarez | 24/DIG. 22 X |
| 3,978,555 | 9/1976 | Weisenthal | 24/562 X |
| 3,983,602 | 10/1976 | Barry . | |
| 4,173,358 | 11/1979 | Wilson | 281/45 |
| 4,340,061 | 7/1982 | Kees, Jr. et al. | 24/562 X |
| 4,521,035 | 6/1985 | Berezowsky | 24/555 X |
| 5,066,154 | 11/1991 | Renaud . | |

FOREIGN PATENT DOCUMENTS

| | | | |
|---|---|---|---|
| 2278810 | 12/1994 | United Kingdom | 401/131 |

*Primary Examiner*—Robert A. Hafer
*Assistant Examiner*—D. Neal Muir
*Attorney, Agent, or Firm*—Peter A. Borsari; Eric W. Trucksess

[57] ABSTRACT

A writing instrument that may be secured or attached to an article, such as a credit card. The inventive writing instrument is configured in the form of a cylindrical casing having at least two opposingly biased resilient jaws or projections extending therefrom, a writing element disposed within said casing and a cap for covering the writing point of the writing element. A credit card or similar article can be easily and conveniently inserted between the resilient jaws or projections and will be securely retained therein.

3 Claims, 1 Drawing Sheet

WRITING INSTRUMENT

FIELD OF THE INVENTION

The present invention relates to hand-held writing instruments, for example, pens pencils and the like, having means to secure or attach an article, such as a credit card, thereto. More specifically, the present invention provides a writing instrument in the form of a cylindrical casing having at least two opposingly biased resilient jaws or projections extending therefrom, a writing element disposed within said cylindrical casing and, optionally, a cap for covering the writing point of the writing element. A credit card or similarly thin article can be inserted between said opposingly biased resilient jaws and secured to said writing instrument.

BACKGROUND OF THE INVENTION

Today's consumer often requires easy access to a writing element, such as a ball-point pen. However, carrying a writing implement is not always practical, particularly when the consumer does not carry a pocketbook, briefcase or bag. Further, storing a writing instrument in one's billfold or wallet is not as simple as carrying a card, such as a credit card. Consumers often use a writing implement and put it down while they are less apt to leave a credit card behind. As a result, they constantly are losing their pens. With the ever-increasing popularity of credit cards, calling cards, ATM cards and the like, many people currently carry at least one card on their person or in their wallet or billfold, Thus, the union of such a card with a writing instrument will provide a writing element immediately available to the user.

The prior art is replete with writing implements having a clip, such as in the form of a cap having a protruding resilient member. Such clips, which make it possible to secure a pen within a shirt pocket are so well-known as to be ubiquitous. It also is known in the entertainment and visual arts to secure a stylus to a drawing board by providing a groove in the stylus which reciprocates with a protruding flange situated on the drawing board. Other securing methods and devices have been directed to attaching a writing implement to articles other than shirt pockets and drawing boards. For example, U.S. Pat. Nos. 5,066,154 and 3,983,602 disclose writing implement holders that are attachable to safety helmets, such that the writing implement is held by a curved clamping means. In U.S. Pat. No. 1,102,992 to Hoffman, a pocket clip for retaining articles is provided having separate clamping means to grip the inside of a shirt pocket or other locale as well as a writing implement.

U.S. Pat. Nos. 2,288,878 to Baer and 2,298,247 to Sampson disclose clips in which a writing instrument is held lengthwise between two clip jaws that also attach to a necktie. In the Baer patent, it is clearly indicated that separate gripping elements are mounted to an exterior surface of the clip for holding a pencil.

U.S. Pat. No. 2,802,250 to Klotz provides a golf score card and scoring pencil holder for a golf club bag having a hook for securing the device to a bag, a recess for receiving and holding a pencil and a narrow V-notch being sufficiently resilient to permit retention or withdrawal of a score card.

U.S. Pat. No. 884,256 to Addie shows a clip having a first pair of jaws for securing the clip to a flat substrate and a second pair of opposingly oriented jaws for receiving a writing implement.

Despite the teachings of the prior art, a need still exists for a device which functions both as a writing element and a clasping mechanism for detachably securing a card, such as a credit card or automatic teller card, thereto. Such a device should be a one-piece unitary structure and configured for easy and accessible use. Such a device also should be of a size sufficient for storage in a wallet, billfold or similar location where credit cards are commonly stored.

SUMMARY OF THE INVENTION

Accordingly, it is an object of the present invention to provide a writing instrument having means for detachably securing an article thereto.

It is another object of the present invention to provide a writing instrument having means for detachably securing a credit card or similar card thereto.

It is an additional object of the present invention to provide a writing instrument having means for easily and quickly securing and detaching a credit card thereto.

It is a further object of the present invention to provide a writing instrument for detachably securing a credit card which is compact and small enough to fit into a billfold, wallet, pocket or other location commonly used for storing credit card.

It is a still further object of the present invention to provide a writing instrument which is economical to manufacture, durable in construction and effective in operation.

These and other objects of the present invention, as embodied and broadly described herein, are achieved by providing a writing instrument having a writing element, for example, a ball point pen, a marker, mechanical pencil lead, a stylus or the like, and having means for detachably securing an article thereto. Such an article may be a card, such as credit card, telephone calling card, ID card and the like. More specifically, the writing instrument of the present invention is fashioned in the form of a cylindrical casing, similar to that of a convention pen, comprising a middle section in the form of a clasping mechanism for securing a card thereto and a cavity or bore longitudinally disposed within the casing for retaining a writing element.

Additional objects, advantages and novel features of the invention will be set forth in part in the description which follows, and in part will become apparent to those skilled in the art upon examination of the following specification or may be learned by practice of the invention. To the accomplishment of the above-related objects, this invention may be embodied in the forms illustrated in the accompanying drawings, attention being called to the fact, however, that the drawings merely are illustrative, and that changes may be made in the specific construction illustrated and described within the scope of the appended claims.

BRIEF DESCRIPTION OF THE DRAWINGS

The present invention will be better understood with reference to the appended drawing sheets, wherein.

DETAILED DESCRIPTION

The present invention relates to a writing instrument in the form of a cylindrical casing having at least two opposingly biased resilient jaws or projections extending therefrom, a writing element disposed within said cylindrical casing and, optionally, a cap for covering the writing point of the writing element. A credit card or similarly thin article can be inserted between said opposingly biased resilient jaws and secured to said writing instrument.

Figure 1:
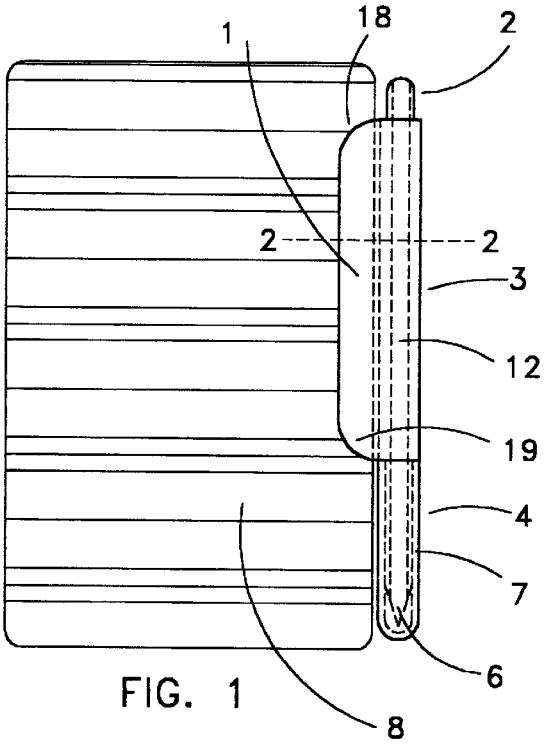
FIG. 1 is a top perspective environmental view of the device showing its attachment to a card.
Figure 2:
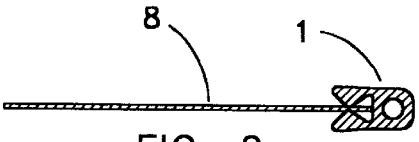
FIG. 2 is an environmental cross sectional view of the device and card shown in FIG. 1 taken along cross sectional line 2—2.
Figure 5:
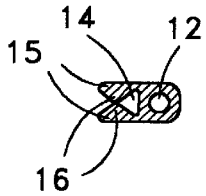
FIG. 5 is a cross sectional view of the device analogous to FIG. 2 shown without the card taken along a cross sectional line analogous to 2—2.

As shown in FIGS. 1, 2 and 5, the writing instrument 1 is in the form of a cylindrical casing comprising a top portion 2, a thickened middle portion 3 configured in the form of a rectangular or elliptical clip, a bottom portion 4, and a cavity or bore 12 longitudinally disposed therein. The middle portion 3, hereinafter sometimes referred to as the clip body 3, comprises two elongated resilient jaws 15 opposingly biased across a groove or cavity 14, said groove or cavity being aligned along the length of the clip body 3 and defined by said opposingly biased jaws 15. Each resilient jaw 15 is triangular in cross section and has a ridge 16 that projects inwardly and is biased toward the opposing jaw. As best viewed in FIGS. 1 and 3, the edges 18 and 19 of each resilient jaw 15 may be rounded in order to facilitate the insertion of the credit card along the length of the writing instrument. In this manner, when a credit card 8 or similar article is inserted within groove 14 of the clip body 3, it will be fixedly but removably held therebetween.

Figure 3:
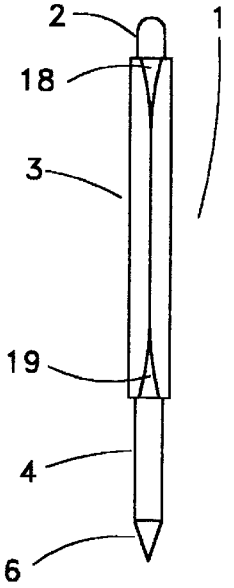
FIG. 3 is a side view of the device.
Figure 4:
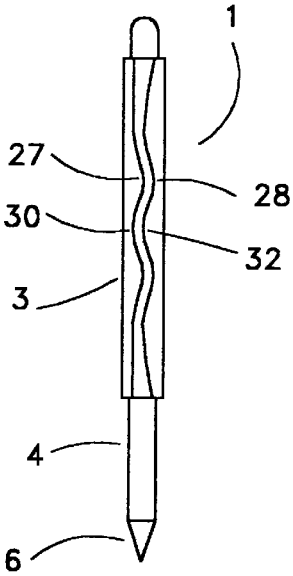
FIG. 4 is a side view of an alternative embodiment of the device.
Figure 11:
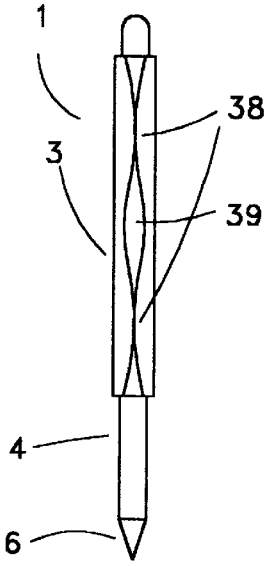
FIG. 11 is a side view of an alternate embodiment of the present invention.

In one embodiment of the writing instrument of the present invention, the cavity or bore 12 longitudinally disposed within the writing instrument 1 is completely enclosed about its perimeter and terminates in a writing point 6 as illustrated in FIGS. 3, 4 and 11. Writing point 6 may be in the form of a nib, ferrule or other conventional writing point depending upon the writing element disposed within the cavity or bore 12. In this embodiment, the cavity or bore 12 is capable of storing and utilizing a liquid ink or pencil lead. Of course, the cavity or bore 12 also is capable of receiving and securely holding a pre-manufactured writing instrument, including for example, a ball point pen, a marker, a stylus, a light pen, a pencil, a pen refill and the like, thereby eliminating the requirement of providing a separate writing point 6.

Figure 6:
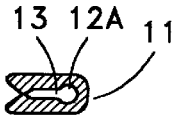
FIGS. 6, 7, 8, 9 and 10 are cross sectional views of alternative embodiments (not illustrated) of the clip device of the instant invention taken along cross sectional lines analogous to that used in FIG. 2.

In an alternate embodiment of the writing instrument of the present invention, the cavity or bore is not completely closed about its perimeter, for example, as shown in FIG. 6, but rather is configured with a slit, groove or similar opening 13 along its longitudinal axis nearest resilient jaws 15. Such an open cavity or bore 12A cannot house a liquid ink, but is capable of receiving and securely holding a premanufactured writing instrument as described above. An advantage of providing an open cavity or bore is that the axis points 11 where the resilient jaws 15 unite with the body of the writing instrument are farther from the point of contact with the credit card, thereby offering a greater torque to the clasping ability of the clip body 3. In both embodiments, the top portion 2 and/or the bottom portion 4 of the writing instrument may be detachable, such as by threads or a snap-lock arrangement, in order to permit the introduction of the writing element into the cavity or bore 12 or 12A.

The writing instrument of the present invention optionally may be provided with a cap 7 as shown in FIG. 1 to protect both the writing point 6 as well as the user's wallet, pocket, or other articles commonly used to store pens and credit cards. The writing instrument 1 generally has a diameter less than that of the conventional pen or pencil, thereby effecting a writing instrument having a sufficiently compact size to accommodate storage in a wallet, billfold or credit card case. Further, the writing instrument should have a length approximating the standard length of a credit card, for example, about the 85.6 mm. In operation, when the user of the present writing instrument requires a writing implement, he simply removes the cap 7 from the bottom end 4 of the cylindrical casing to expose the writing point 6 and disengages the card 8 from the resilient jaws 15. When the writing instrument 1 is provided with a cap 7, the user may insert top portion 2 into said cap 7, thereby lengthening the writing implement and facilitating writing therewith.

The present writing instrument preferably is composed of any flexible and resilient material, including, for example, rubber, plastic or hardened sponge, although other, stiffer materials, including, for example, hardened plastics, hardened rubber, metal or wood, may be used in the manufacture of the present invention. Preferably, the material should be sufficiently resilient to permit the user to insert a card into the groove 14 and should have enough friction force to enable the clip body to retain the inserted card as well as being sufficiently flexible to permit extraction of an inserted card without undue effort. Either or both top portion 2 and bottom portion 4 may be sheathed in a harder, less flexible material, such as metal, to enhance durability of the writing instrument.

Figure 7:
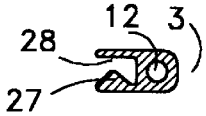
Figure 8:
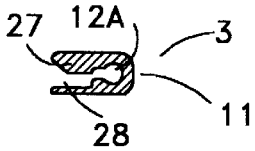

FIGS. 4, 7 and 8 illustrate a first alternate embodiment of the middle portion 3 of the present writing instrument. Referring to FIG. 4, the middle portion 3 is shown with resilient jaws 15 being configured with a wavy contour. In this manner, each jaw can apply pressure at multiple, defined points on an inserted card. As seen in FIG. 4, a first jaw has a ridge 27 corresponding to the flat surface 28 of the second jaw 28 and a flat surface 30 corresponding to the ridge 32 of the second jaw. As shown in the cross sectional view in FIG. 7, in this alternate embodiment, ridge 27 does not touch flat surface 28. As discussed above, the cavity or bore longitudinally disposed within the writing instrument 1 may be open or closed. FIGS. 7 and 8 depict the first alternate embodiment of the writing instrument fashioned with the closed cavity or bore 12 and an open cavity or bore 12A respectively.

Figure 9:
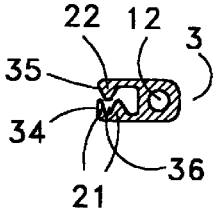
Figure 10:
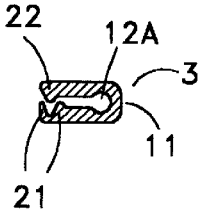

FIGS. 9 and 10 depict a second alternate embodiment of the present invention fashioned with a closed cavity or bore 12 and an open cavity or bore 12A respectively. In this second alternate embodiment, the middle portion 3 has a pair of asymmetric jaws 34, 35 with elongated ridges. Referring to FIG. 9, a first jaw 34 is configured with two projecting ridges 21 and the second jaw 35 is configured with one ridge 22 that projects inwardly towards the recess 36 of the first jaw 34.

FIG. 11 shows a third alternate embodiment of the middle portion 3 of the present invention. In this embodiment, rather than each jaw having elongated ridges along the entire surface, each jaw has several regions of elongated ridges 38 separated by recesess 39.

While particular embodiments of the invention have been described, it will be understood, of course, that the invention is not limited thereto, and that many obvious modifications and variations can be made, and that such modifications and variations are intended to fall within the scope of the appended claims.

What is claimed is:

1. A writing instrument having means for detachably securing a card thereto comprising:

an essentially cylindrical casing having a cavity or bore longitudinally disposed therein;

an essentially cylindrical writing element housed within said cavity or bore;

a pair of essentially planar extensions integrally formed with said essentially cylindrical casing and being resiliently opposed toward each other to define a groove therebetween, said pair of essentially planar extensions having a matingly wavy contour undulating along a longitudinal axis;

at least one ridge directed along a longitudinal axis of at least one of said essentially planar extensions and directed into said groove, whereby a card inserted into said groove or cavity is intermittently engaged by said ridge to secure the card within said groove.

2. A writing instrument having means for detachably securing a card thereto comprising:

an essentially cylindrical casing having a cavity or bore longitudinally disposed therein, a writing element housed within said cavity or bore;

a pair of essentially planar extensions being tangentially attached to said essentially cylindrical casing and being resiliently opposed toward each other to define a groove therebetween, said pair of essentially planar extensions having a matingly wavy contour undulating along a longitudinal axis;

each of said essentially planar extensions having at least one ridge directed along a longitudinal axis of said essentially planar extensions and directed into said groove, whereby a card inserted into said groove or cavity is intermittently engaged by said ridges to secure the card within said groove.

3. A writing instrument having in accordance with claim 2, wherein said ridges alternately engage opposite sides of a card inserted into said groove.

* * * * *